US005739637A

United States Patent [19]

Boettcher

[11] Patent Number: 5,739,637

[45] Date of Patent: Apr. 14, 1998

[54] COLD CATHODE VACUUM DISCHARGE TUBE

[75] Inventor: Gordon E. Boettcher, Albuquerque, N. Mex.

[73] Assignee: Sandia Corporation, Albuquerque, N. Mex.

[21] Appl. No.: 535,795

[22] Filed: Sep. 28, 1995

[51] Int. Cl.[6] ..... H01J 17/48; H01J 17/30; H01J 17/46; H01J 61/54

[52] U.S. Cl. ..... 313/589; 313/602; 313/603

[58] Field of Search ..... 313/589, 590, 313/601, 603, 602, 609, 217; 361/2, 5, 117, 120, 220, 345, 355; 337/28, 602; 427/37

[56] References Cited

U.S. PATENT DOCUMENTS 3,663,855 5/1972 Boettcher ..... 313/178
3,772,570 11/1973 Lange et al. ..... 313/217 X
4,123,682 10/1978 Lange et al. ..... 313/217 X
4,404,234 9/1983 Zuk ..... 427/37
5,142,194 8/1992 Jacubeit et al. ..... 313/601 X
5,189,345 2/1993 Branston et al. ..... 313/590 X

*Primary Examiner*—Ashok Patel
*Assistant Examiner*—Mack Haynes
*Attorney, Agent, or Firm*—Timothy D. Stanley

[57] ABSTRACT

A cold cathode vacuum discharge tube, and method for making same, with an interior surface of the trigger probe coated with carbon deposited by carbon vapor deposition (CVD) or diamond-like carbon (DLC) deposition. Preferably a solid graphite insert is employed in the probe-cathode structure in place of an aluminum bushing employed in the prior art. The CVD or DLC probe face is laser scribed to allow resistance trimming to match available trigger voltage signals and to reduce electrical aging.

10 Claims, 10 Drawing Sheets

COLD CATHODE VACUUM DISCHARGE TUBE

GOVERNMENT RIGHTS

The Government has rights to this invention pursuant to Contract No. DE-AC04-76DP00789 awarded by the U.S. Department of Energy.

BACKGROUND OF THE INVENTION

1. Field of the Invention (Technical Field)

The present invention relates to vacuum discharge tubes and methods for making same.

2. Background Art

As discussed in U.S. Pat. No. 3,663,855, to Boettcher, cold cathode vacuum discharge tubes may be used in any application requiring fast switching of large currents. The tubes, or switches, usually provide an open circuit relationship between a source of current and a load. The tube is pulsed by a signal to effect an electric discharge within the tube, switching the tube to electrical conduction and passing a current pulse from the source to the load.

Applications in which cold cathode vacuum discharge tubes have been employed include firing exploding bridge wire detonator and slapper detonator assemblies, radar systems, high energy physics, power supplies, and capacitor bank discharging. Especially for applications in space, such tubes must have stable operating characteristics over a long life and so are best kept simple and dependable.

FIGS. 1–3 illustrate the state of the art in design of cold cathode vacuum discharge tubes, as well as the relative complexity of present tubes. FIG. 1 shows a single probe-header ceramic switch 10, including exhaust pinch-off 12, ceramic envelope (94% $Al_2O_3$) 14, niobium anode 16, niobium cathode support 18, aluminum cathode 20, probe ceramic 22, discoidal filter capacitor 24, trigger 26, cathode strip line 28, Kapton insulator 30 (insulator polyimide film by Dupont), carbon coating 32, and copper anode strip line 34. FIG. 2 shows a double probe-header ceramic switch 40, which is quite similar to the switch 10 of FIG. 1, but illustrates the use of anode terminal 42, copper brazes 44, Kovar 46 (alloy of Westinghouse Electric of Ni 29%, Co 17%, and Fe balance), trigger leads 48, filter capacitors 50, and twin trigger probes 52. FIG. 3 illustrates a flat vacuum switch 60, which employs similar parts as in FIGS. 1 and 2, but arranged to provide a flat switch; additional identified components are negative trigger lead 62, positive trigger lead 64, molybdenum trigger pin 70, and Sn/Pb solder fill 72.

The prior art devices have the following main disadvantages: (1) they are relatively complex and require a large number of parts; (2) they requires troublesome craft-type operations during manufacture, such as carbon doping and hand soldering; and (3) they requires certain expensive processing, such as laser welding, exhausts, and gold plating. The present invention remedies these deficiencies and provides certain additional advantages discussed below.

SUMMARY OF THE INVENTION (DISCLOSURE OF THE INVENTION)

The present invention is of a cold cathode vacuum discharge tube apparatus comprising: a trigger probe comprising an inner surface; and a coating on the inner surface which is a carbon vapor deposition coating or a diamond-like carbon coating. In the preferred embodiment, the trigger probe comprises a trigger wire composed of an alloy of approximately 65% Pd and 35% Co, and a graphite insert surrounds the trigger probe. The coating is preferably laser scribed, most preferably in a complete circle about the trigger wire or in a circle with one or more gaps in the laser scribing.

The invention is also of a method of manufacturing a cold cathode vacuum discharge tube, comprising coating a surface of a trigger probe ceramic either by carbon vapor deposition or diamond-like carbon deposition. In the preferred embodiment, a ceramic header and envelope are metallized and nickel plated, a graphite insert is Pt sputtered, components are brazed in a vacuum braze oven, the tube is nickel plated and then Sn/Pb plated, and the coated surface is laser scribed (preferably in a complete circle about a trigger wire or in a circle with one or more gaps in the laser scribing).

The invention is further of a method of reducing electrical aging and allowing resistance trimming in a component, comprising laser scribing a surface of the component. In the preferred embodiment, the laser scribing is performed to laser scribe a complete circle or a circle with one or more gaps in the laser scribing.

The invention is additionally of a cold cathode vacuum discharge tube comprising: a trigger probe comprising an inner surface; a coating on the inner surface which is either a carbon vapor deposition coating or a diamond-like carbon coating; and laser scribing on the coating. In the preferred embodiment, the laser scribing comprises a complete circle about a trigger wire or a circle with one or more gaps in the laser scribing.

The primary objects of the present invention are to permit use of more modern and technically controllable processes in cold cathode vacuum discharge tube manufacture and design, to improve hold-off voltage characteristics and pulse life, and to permit closure with a single vacuum braze.

A primary advantage of the present invention is reduction in complexity and number of parts required.

Another advantage of the present invention is that it substantially eliminates troublesome craft-type operations during manufacture, including carbon doping and hand soldering.

An additional advantage of the present invention is that it substantially eliminates certain expensive processing required during manufacture, such as laser welding, exhausts, and gold plating.

Still another advantage of the present invention is that switches may be manufactured in a quarter or less of the time to manufacture prior art devices, and at a tenth or less in cost, with the same or improved high reliability and impermeability to hydrogen atmospheres.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The present invention is of a cold cathode vacuum discharge tube having the most interior surface of the trigger probe coated with carbon deposited by carbon vapor deposition (CVD) or diamond-like carbon (DLC) deposition. Preferably a solid graphite insert is employed in the probe-cathode structure in place of an aluminum bushing employed in the prior art. The CVD or DLC probe face is laser scribed to allow resistance trimming to match available trigger voltage signals.

Figure 1:
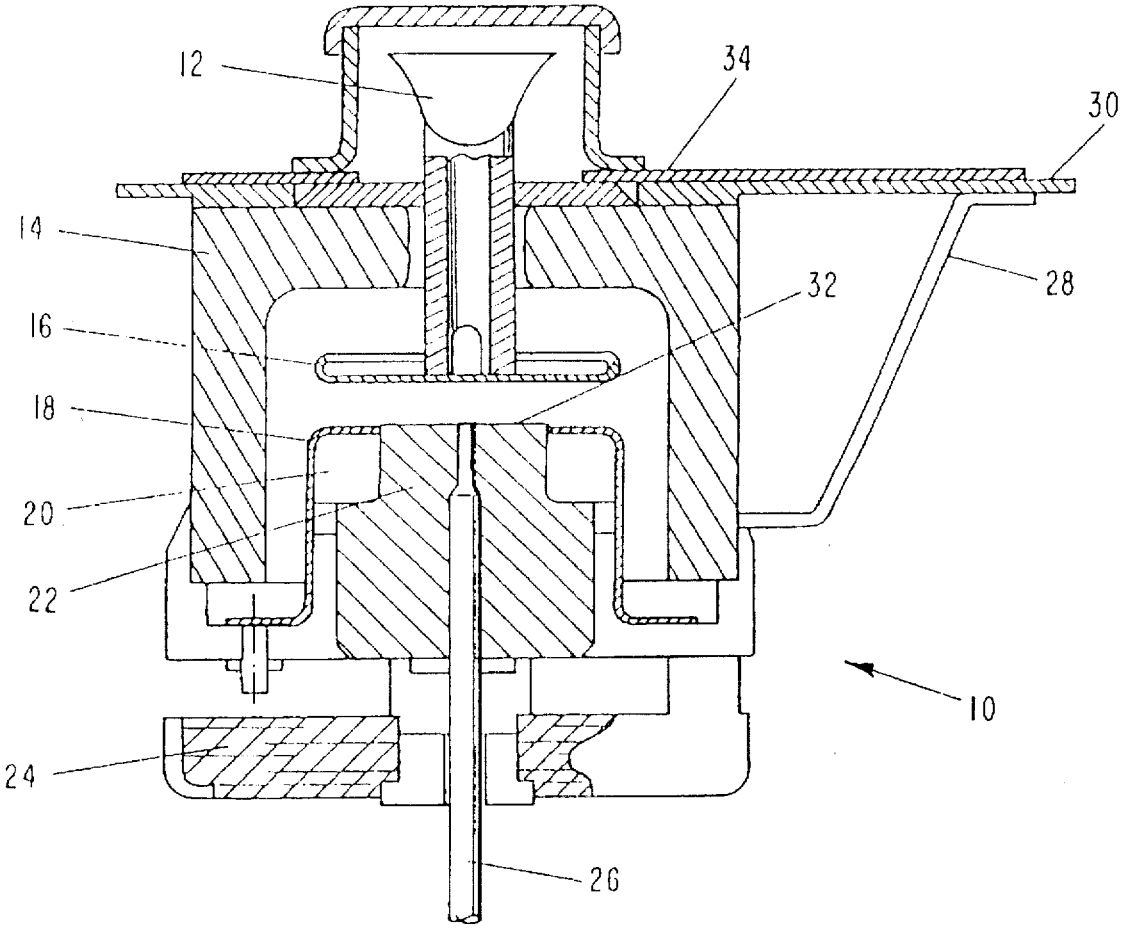
FIG-1 PRIOR ART
FIG. 1 is a schematic cross-section view of a prior art single probe-header ceramic vacuum discharge tube.
Figure 2:
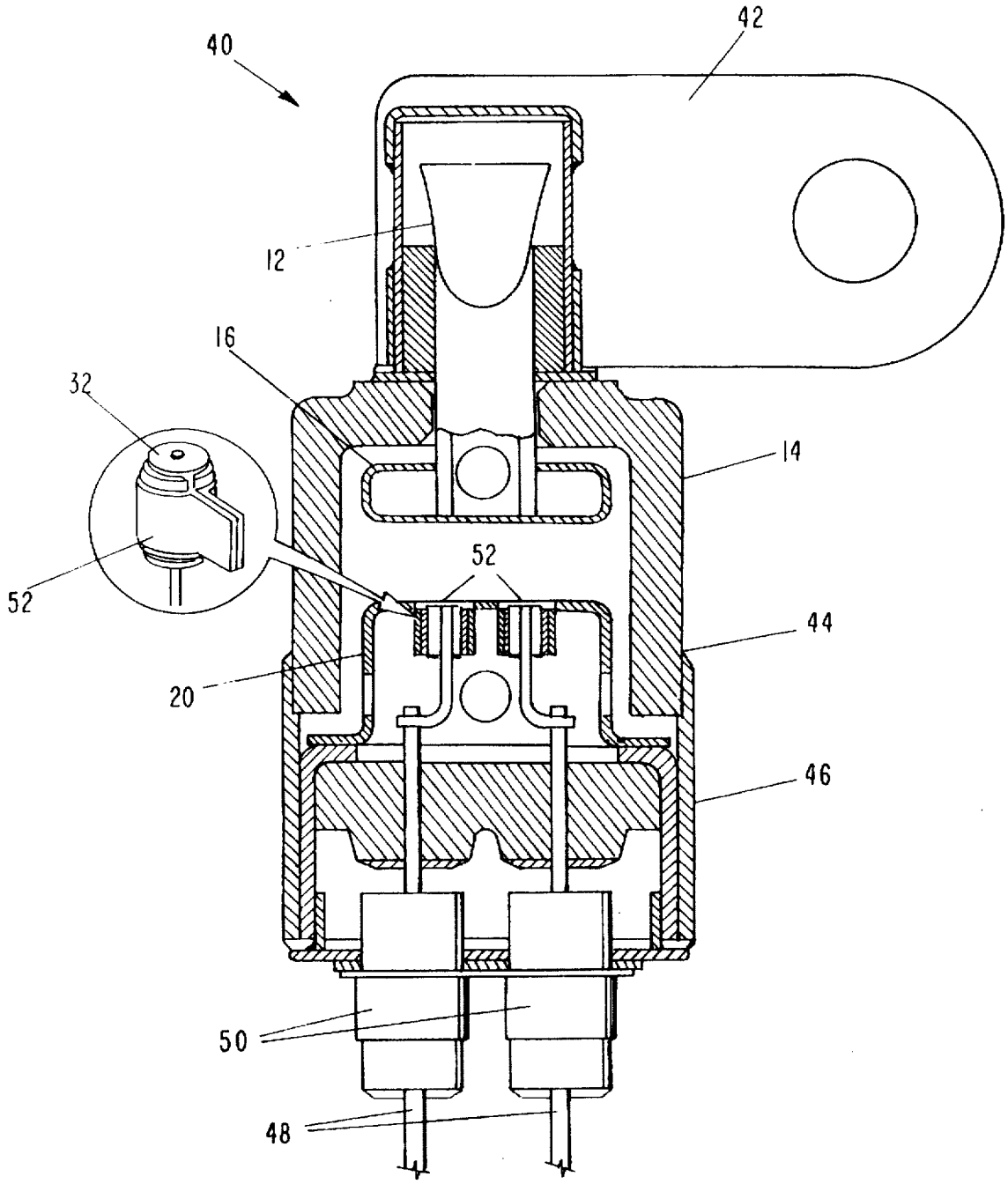
FIG-2 PRIOR ART
FIG. 2 is a schematic cross-section view of a prior art double probe-header ceramic vacuum discharge tube.
Figure 3:
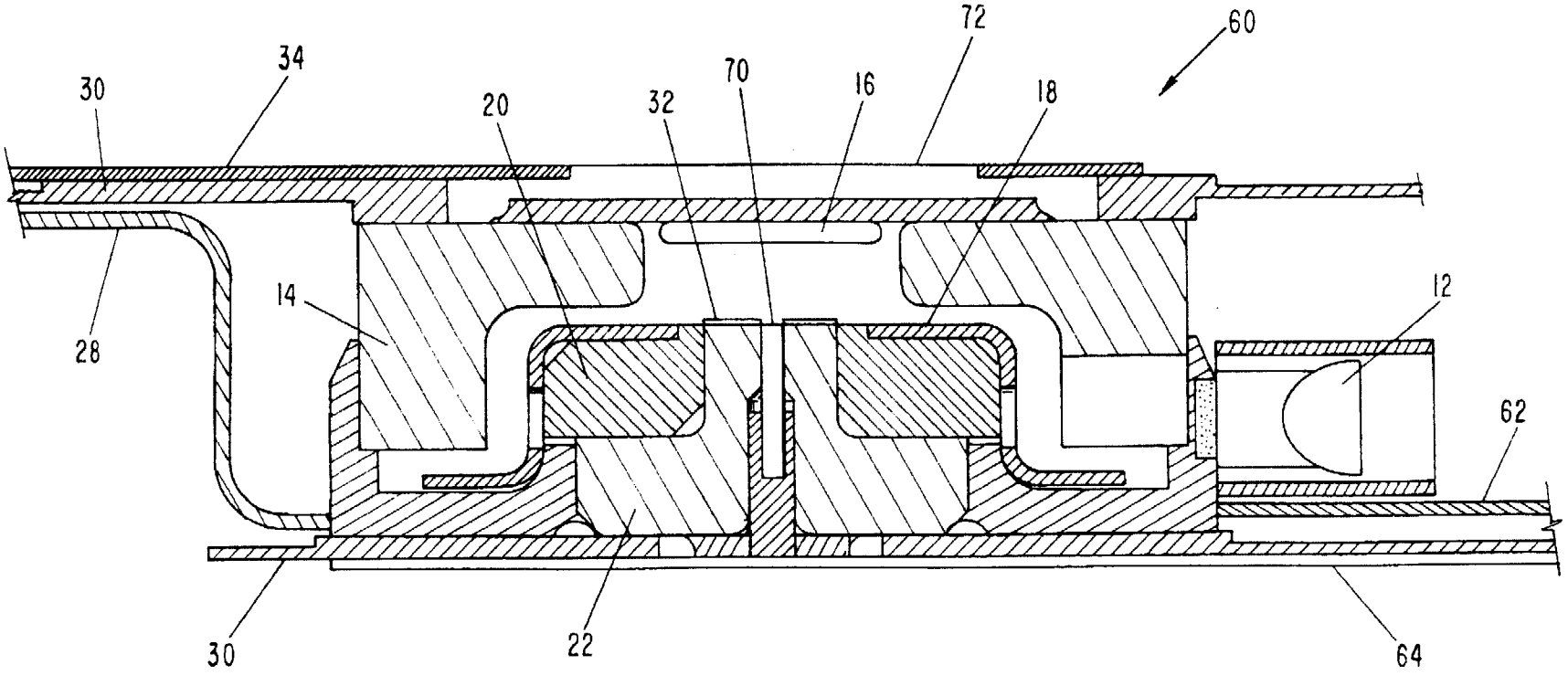
FIG-3 PRIOR ART
FIG. 3 is a schematic cross-section view of a prior art flat vacuum discharge tube.
Figure 4:
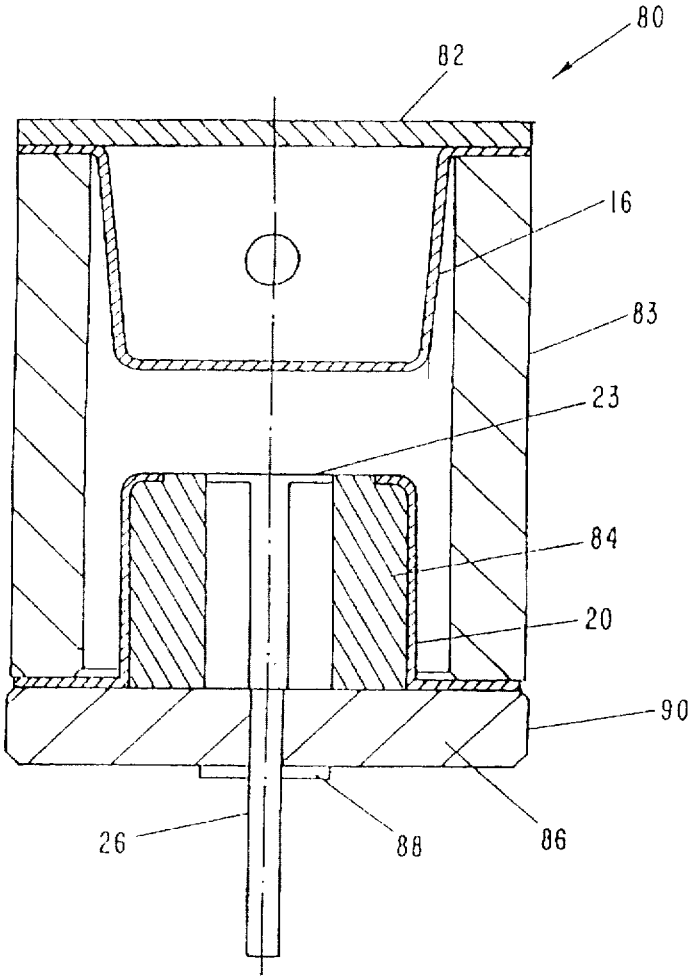
FIG. 4 is a schematic cross-section view of a single probe-header cold cathode vacuum discharge tube of the present invention.
Figure 5:
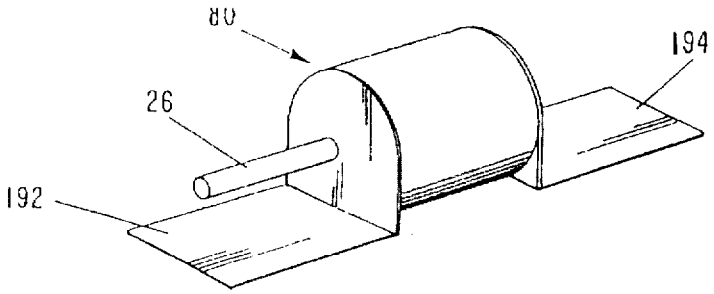
FIG. 5 is an external perspective view of the embodiment of FIG. 4.

FIGS. 4 and 5 illustrate an embodiment of the invention of extreme design and manufacture simplicity. An exemplary dimension of the device is 0.32" by 0.41", with a 0.050" gap between anode and cathode. Switch 80 is capped by a disc 82 (preferably molybdenum) above anode 16 (preferably niobium) and ceramic envelope 83 (preferably 94% $Al_2O_3$). The probe is formed of trigger probe 26 (preferably Palco alloy, 65% Pd and 35% Co), CVD or DLC coated ceramic 23 (preferably 94% $Al_2O_3$), graphite insert 84, and cathode 20 (preferably niobium). The base is formed by ceramic 86 (preferably 94% $Al_2O_3$) with coating 90 (preferably Mo/Mn, most preferably with a Nicoro braze material of 35% Au, 62% Cu, and 3% Ni, with a liquidus of 1050° C.) and disc 88 (preferably molybdenum). As shown in FIG. 5, cathode tab 192 and anode tab 144 may be attached to switch 80, preferably after the tube has been vacuum brazed, nickel plated, and Sn/Pb plated.

Figure 14:
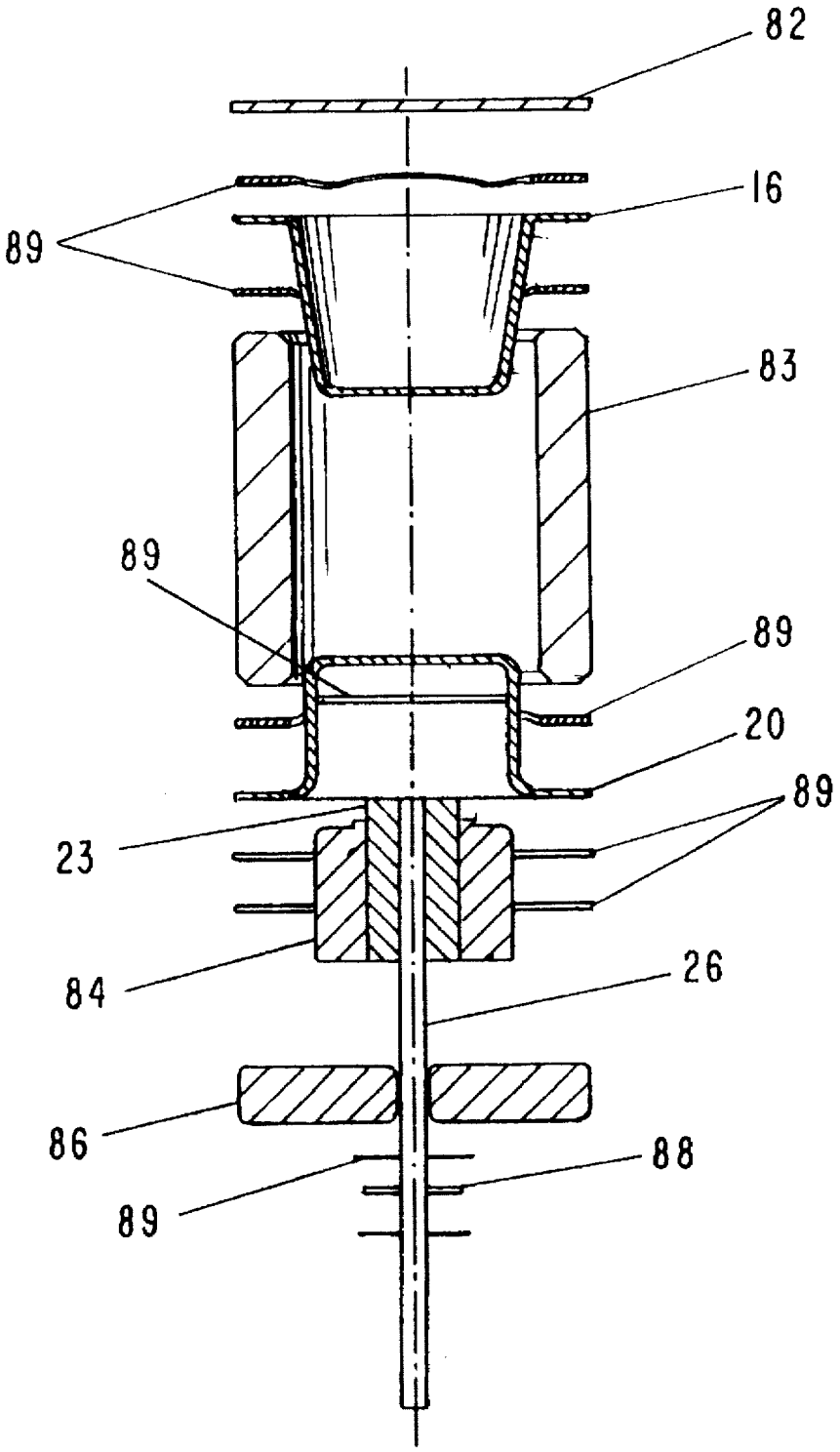
FIG. 14 is a plan view of a brazing assembly used in manufacture of the tubes of the invention.

The embodiment of FIGS. 4 and 5 is manufactured as follows: (1) parts are cleaned and vacuum fired as required; (2) ceramic 35 header and envelope are metallized and nickel plated; (3) probe ceramic is CVD or DLC coated and laser scribed as in FIGS. 7 and 8 and accompanying text; (4) graphite insert is Pt sputtered; (5) parts are stacked in braze fixture as illustrated in FIG. 14 (note Nicoro braze washers 89) and placed in vacuum braze oven where vacuum is attained and temperature increased to 1050° C. to seal tube; (6) tube is nickel plated, followed by Sn/Pb plate; (7) branded with type number, date code, and serial number, and anode/cathode terminals, trigger filter capacitor, and so forth are added as necessary for the application; and (8) acceptance testing, packaging, and delivery are performed.

Accordingly, a fairly limited production facility is required to produce tubes according to the invention. The basic processing capabilities required are wet chemistry for part cleaning and etching; vacuum firing at 1400° C. for niobium outgassing; sputter (Pt) coating device for graphite top surface coating; air firing furnace for final cleaning step on bare ceramics prior to coating; furnace with methane gas at 1100° C. for CVD coating or high pulsed power laser for DLC coating; vacuum braze oven for final closure; Ni and Sn/Pb plating baths; vapor phase soldering process for contact attachments; marking equipment for indicia including data code and serial number; and acceptance, maintenance, and calibration equipment.

The tubes of the present invention should have the following characteristics and abilities: anode voltage range of 500 to 6,000 Vdc; discharge peak current of 300 to 18,000 A; discharge capacitance of 0.165 to 4 μF; timing/jitter (10 shot variation) of 17 to 200 ns; low inductance tube connections with slapper detonator use; and trigger voltage of 400 to 2,000V. However, envelope size and internal dimensional changes will be required for different applications to accommodate a definite set of switching parameters for maximum reliability and shot life.

Figure 6:
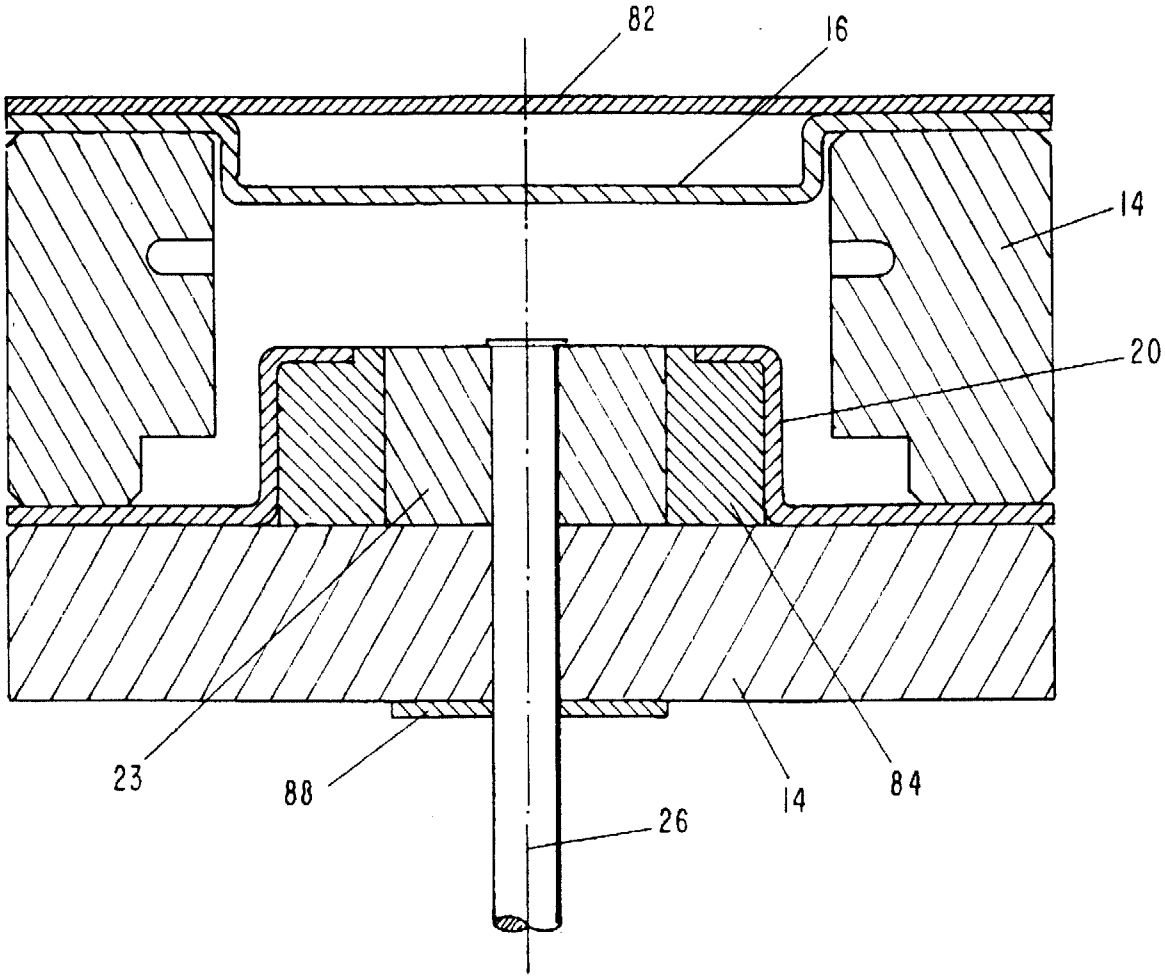
FIG. 6 is a schematic cross-section view of a flat cold cathode vacuum discharge tube of the present invention.

FIG. 6 illustrates a flat cold cathode vacuum discharge tube of the invention. It is of similar construction and is of similar simplicity to the embodiment of FIGS. 4 and 5, and is manufactured in an essentially identical fashion.

To allow tubes according to the invention to function consistently, one may electrically probe age the CVD or DLC film on ceramic 23. This may be done by switching current pulses of 250 ns duration and 0.1 kA to 0.5 kA peak current through the CVD or DLC, which causes a change in its resistance and formation of openings or gaps at probe wire to CVD or DLC and CVD or DLC to graphite interfaces. These gaps typically occur at points of weak interface connections, and due in part to part irregularities were not ideally located.

Figure 7:
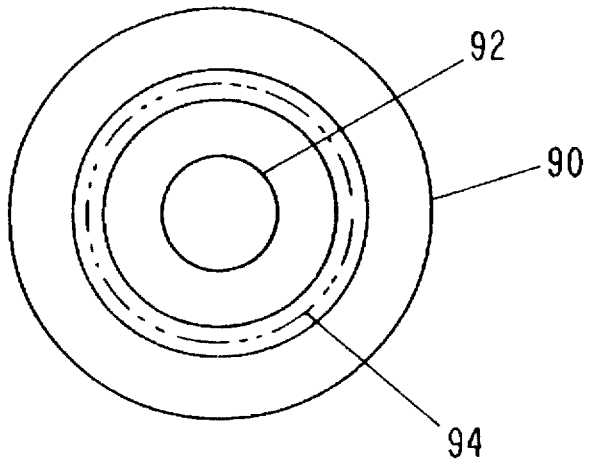
FIG. 7 is a schematic cross-section view of a CVD carbon coated probe of the invention having a continuous 360 laser scribed gap.
Figure 8:
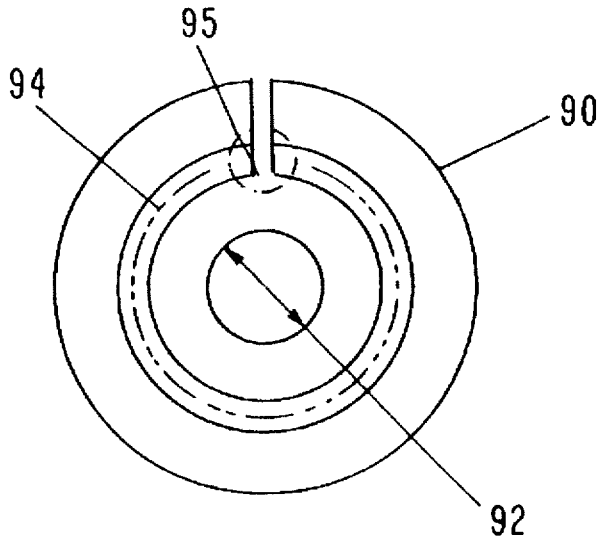
FIG. 8 is a schematic cross-section view of a carbon vapor deposition (CVD) carbon coated probe of the invention having a laser scribed gap not 360 complete.

To overcome formation of such gaps, it is preferred to laser scribe the CVD or DLC probe face. This eliminates or reduces electrical aging, is more precise, controllable, and cost effective. Referring to FIG. 7, the CVD or DLC coated ceramic probe face 90 includes probe wire 92 and laser scribe gap 94. Gap 94 may be a series of dots and/or a continuous gap cut to open up resistance. The trigger spark will occur across gap 94. Referring to FIG. 8, gap 94 may be scribed so as not to be 360° complete, which allows the trigger spark or arc to occur at the unscribed high resistance point 95.

Laser scribing may be performed by, for example, the following types of equipment:

1. Q switched Nd:YAG CW system available from commercial suppliers doing engraving. This system removes carbon on the probe face but does not penetrate into the ceramic.
2. A 200 W Nd:YAG CW system used for laser welding. This system removes CVD carbon and cuts an approximate ½ mil groove in the ceramic probe face, thus making it harder for subsequent tube erosion to short out the scribed portion of the CVD or DLC coating.

An advantage of the DLC embodiment of the present invention is that the DLC process can include masking to deposit coating only on specific areas of a ceramic part. This permits design variations not possible with the CVD process. The DLC coating is produced with a high pulsed power laser deposition (PLD) process, which deposits films in a direct line of sight at room temperature. This is in contrast to CVD, which is performed at approximately 1100° C. and by which all exposed surfaces of the part are coated. By adjusting DLC deposition conditions, carbon properties such as resistivity, density, and local bonding structure can be varied.

Industrial Applicability

The invention is further illustrated by the following nonlimiting examples.

EXAMPLE 1

Figure 9:
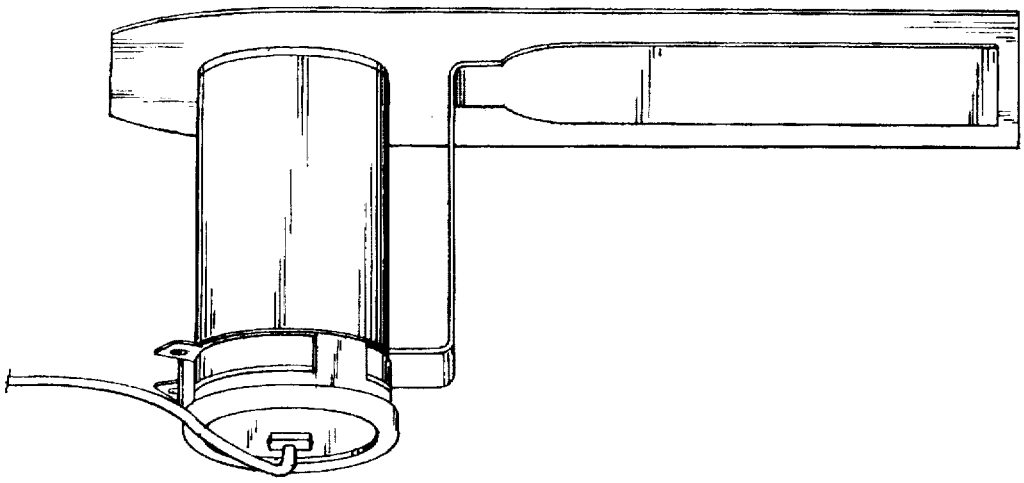
FIG. 9 is a perspective view of a first cold cathode vacuum discharge tube manufactured according to the invention.

Referring to FIG. 9, a vacuum switch according to the CVD embodiment of the present invention was constructed which was 0.32" by 0.645", anode voltage of 5.0 KVdc, discharge capacitance of 0.3 μF, discharge peak current of approximately 6,500 A, maximum trigger voltage of 1,100 V, jitter of less than 30 ns, and a life of greater than 100 pulses.

EXAMPLE 2

Figure 10:
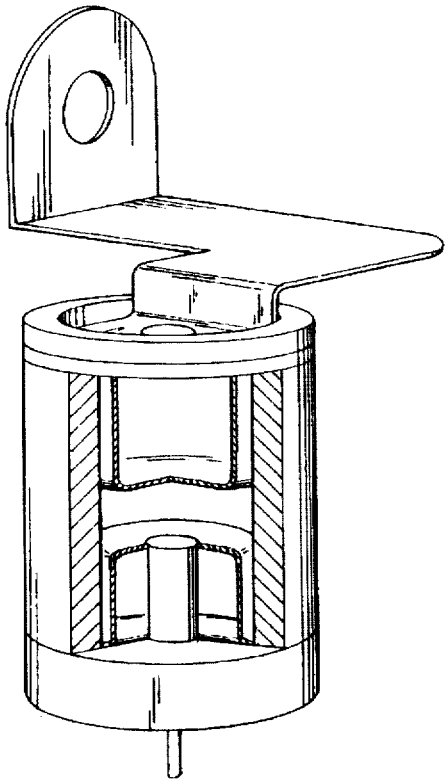
FIG. 10 is a perspective view of a second cold cathode vacuum discharge tube manufactured according to the invention.

Referring to FIG. 10, a vacuum switch according to the CVD embodiment of the present invention was constructed which was 0.48" by 0.695", anode voltage of 6.0 KVdc, discharge capacitance of 3 μF, discharge peak current of approximately 18 KA, maximum trigger voltage of 1,500 V, jitter of less than 50 ns, and a life of greater than 100 pulses.

EXAMPLE 3

Figure 11:
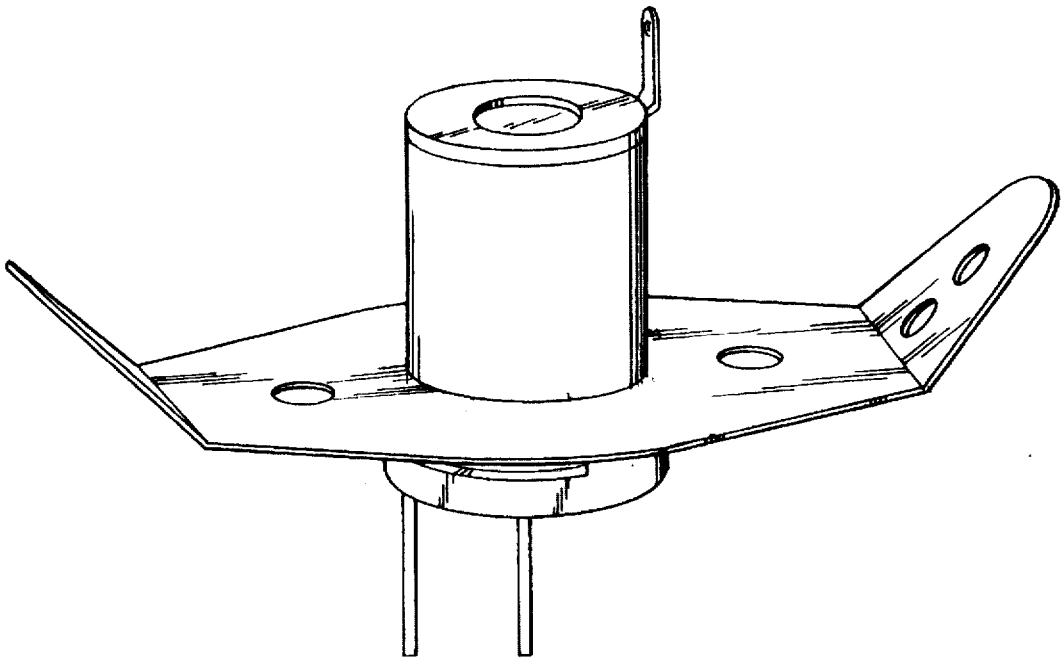
FIG. 11 is a perspective view of a third cold cathode vacuum discharge tube manufactured according to the invention.

Referring to FIG. 11, a vacuum switch according to the CVD embodiment of the present invention was constructed which was 0.32" by 0.41", anode voltage of 2.5 KVdc, discharge pulse forming line with peak current of approximately 300 A and 12 μs pulse width, maximum trigger voltage of 380 V, jitter of less than 50 ns, and a life of greater than 500 pulses.

EXAMPLE 4

Figure 12:
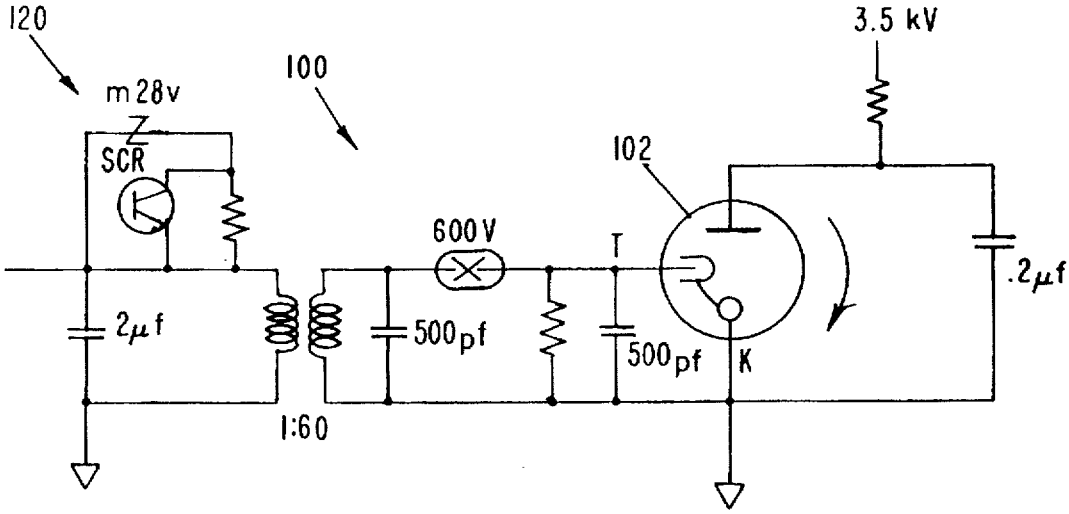
FIG. 12 is a schematic of a first test circuit employed to test the embodiments of the cold cathode vacuum discharge tube of the invention.

FIG. 12 illustrates a test circuit 100 useful in testing cold cathode vacuum discharge tubes 102 of the invention. The non-conventional parts are strip-line low inductance circuit 106 and 0.25/0.005 ohm coaxial divider 104. A tube having $V_L$ (anode voltage required to obtain 2 nA of leakage current between anode and cathode electrodes) initially of 6 KVdc, discharge peak current of 6,000 A, pulse width of 240 ns, and time to peak current of 80 ns, was fired for 4,357 pulses successfully prior to misfire (inability to be triggered). $V_L$ at the end of pulse life was 5 KVdc.

EXAMPLE 5

Figure 13:
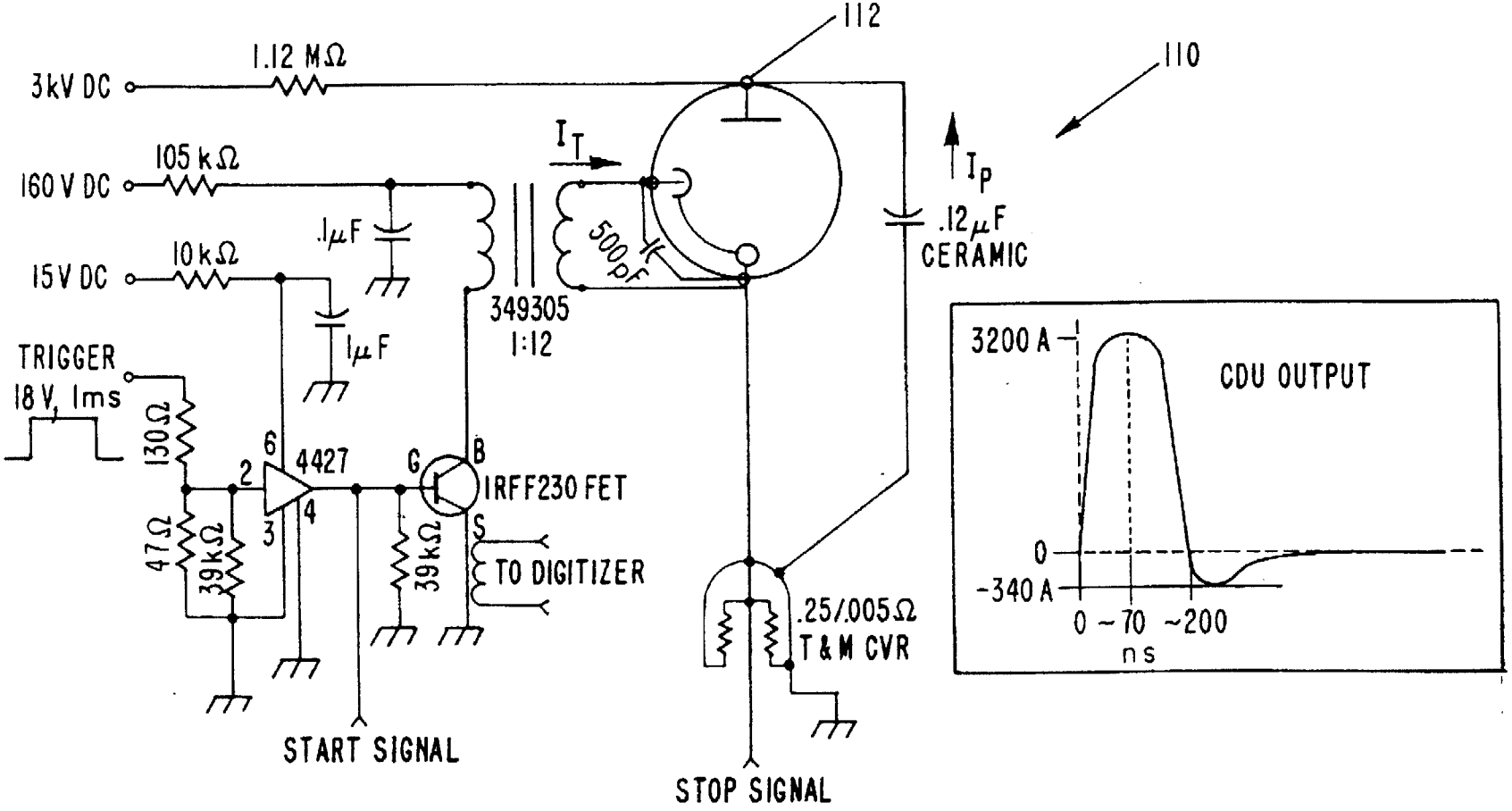
FIG. 13 is a schematic of a first test circuit employed to test the embodiments of the cold cathode vacuum discharge tube of the invention.

FIG. 13 illustrates a typical application circuit 110 for the cold cathode vacuum discharge tubes 112 of the invention. The nonconventional parts are strip-line low inductance circuit 106 and 0.25/0.005 ohm coaxial divider 104. The trigger circuit provides a ≈688 volt open circuit voltage across 500 pF to switch 12 μf into a 250 ohm load for ≈3200 A output. Rise time is ≈2.7 V/ns; $I_T$ is ≈2 A into 0.1 ohms CVR; typical firing time measured from FET trigger to leading edge of current output is ≈200–300 ns; typical shot jitter is 20–40 ns. The useful pulse life is thousands of operations.

EXAMPLE 6

Four cold cathode vacuum discharge tubes of the CVD embodiment of the present invention were stored at 150° C. in 1,500 psi hydrogen for six days with no noticeable change in electrical characteristics. Accordingly, the tubes do not appear to be permeating $H_2$.

EXAMPLE 7

Vacuum switches according to the DLC embodiment of the present invention were constructed according to the following laser conditions: deposition time of 30 minutes; laser repetition rate of 40 Hz; laser energy of 227 mJ; and laser spot size of 0.1 $cm^2$; resulting in a carbon film thickness of 0.5μ and two point resistivity of approximately 500 ohms in a completed tube.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A cold cathode vacuum discharge tube apparatus comprising:

a trigger probe comprising an inner surface; and a coating on said inner surface selected from the group consisting of carbon vapor deposition coatings and diamond-like carbon coatings.

2. The apparatus of claim 1 wherein said trigger probe comprises a trigger wire comprising an alloy of approximately 65% Pd and 35% Co.

3. The apparatus of claim 1 wherein said apparatus comprises a graphite insert surrounding said trigger probe.

4. The apparatus of claim 1 wherein said coating is laser scribed.

5. The apparatus of claim 4 wherein said coating is laser scribed in a complete circle about a trigger wire.

6. The apparatus of claim 4 wherein said coating is laser scribed in a circle about a trigger wire, said circle comprising one or more gaps in said laser scribing therein.

7. A cold cathode vacuum discharge tube apparatus comprising:

a trigger probe comprising an inner surface;

a coating on said inner surface selected from the group consisting of carbon vapor deposition coatings and diamond-like carbon coatings; and laser scribing on said coating.

8. The apparatus of claim 7 wherein said laser scribing comprises a complete circle about a trigger wire.

9. The apparatus of claim 4 wherein said laser scribing comprise a circle about a trigger wire, said circle comprising one or more gaps in said laser scribing therein.

10. A cold cathode vacuum discharge tube apparatus having an anode, a cathode, and means for maintaining the anode and the cathode in a vacuum, said apparatus comprising:

a) a trigger probe comprising an inner surface; and b) a coating on said inner surface selected from the group consisting of: carbon vapor deposition coatings, and diamond-like carbon coatings.

* * * * *